US008528851B2

(12) United States Patent
Friesen et al.

(10) Patent No.: US 8,528,851 B2
(45) Date of Patent: Sep. 10, 2013

(54) PAPER ROLL DISPENSER WITH SENSOR ATTACHED TO MANUAL ACTUATOR

(75) Inventors: Matthew Friesen, Surrey (CA); Bradley Friesen, Vancouver (CA); John Friesen, Vancouver (CA); Andrew Jackman, Langley (CA); Lockland Corley, Coquitlam (CA); Richard Lalau, North Vancouver (CA); Michael Severyn, Surrey (CA); Alex Tramploski, Richmond (CA); Joel Keily, Corona, CA (US)

(73) Assignee: Dispensing Dynamics International, City of Industry, CA (US)

( * ) Notice: Subject to any disclaimer, the term of this patent is extended or adjusted under 35 U.S.C. 154(b) by 790 days.

(21) Appl. No.: 12/688,157

(22) Filed: Jan. 15, 2010

(65) Prior Publication Data

US 2010/0176237 A1 Jul. 15, 2010

Related U.S. Application Data

(60) Provisional application No. 61/144,994, filed on Jan. 15, 2009.

(51) Int. Cl.
*B65H 20/02* (2006.01)

(52) U.S. Cl.
USPC ..... 242/564.4; 242/563; 242/565

(58) Field of Classification Search
USPC ..... 242/563, 564, 564.1, 564.2, 564.3, 242/564.4, 565
See application file for complete search history.

(56) References Cited

U.S. PATENT DOCUMENTS

| | | | | |
|---|---|---|---|---|
| 3,737,087 | A * | 6/1973 | Rooklyn | 242/564.4 |
| 4,666,099 | A * | 5/1987 | Hoffman et al. | 242/564.1 |
| 6,892,620 | B2 * | 5/2005 | Kapiloff | 242/563 |
| 7,044,421 | B1 * | 5/2006 | Omdoll et al. | 242/564.4 |
| 7,523,885 | B2 * | 4/2009 | Lewis | 242/563 |
| 7,931,228 | B2 * | 4/2011 | Omdoll | 242/563 |
| 8,082,827 | B2 * | 12/2011 | Friesen et al. | 83/649 |
| 2007/0079684 | A1 * | 4/2007 | Friesen et al. | 83/649 |
| 2007/0194166 | A1 * | 8/2007 | Reinsel et al. | 242/563 |
| 2010/0102101 | A1 * | 4/2010 | Keily et al. | 242/564.2 |
| 2010/0301157 | A1 * | 12/2010 | Keily et al. | 242/564.1 |

* cited by examiner

*Primary Examiner* — William A Rivera
(74) *Attorney, Agent, or Firm* — Thomas R. Lampe

(57) ABSTRACT

A hybrid towel dispenser is provided that is operable in an automatic dispensing mode and a manual dispensing mode. The dispenser comprises a rotatable drum; a motor; a one-way bearing coupling the motor to the drum such that the motor rotates the drum in the automatic dispensing mode and a user can rotate the drum in the manual dispensing mode separately from the motor. The sensor controlling the motor has a sensing path through the user engagement surface of the manual advance assembly. The dispenser can additionally have a manual advance assembly with a lever rotationally coupled to the cutting drum and operable by the user to rotate the drum in the manual dispensing mode.

21 Claims, 13 Drawing Sheets

PAPER ROLL DISPENSER WITH SENSOR ATTACHED TO MANUAL ACTUATOR

RELATED APPLICATIONS

This application incorporates by reference U.S. application Ser. No. 11/245,585 filed on Oct. 7, 2005, application Ser. No. 11/423,100 filed on Jun. 8, 2006, and Canadian application 2,541,645 entitled "Hybrid Towel Dispenser" and filed on Apr. 3, 2006 for all teachings, disclosures and purposes.

This application claims priority benefit of U.S. Ser. No. 61/144,994, filed Jan. 15, 2009.

BACKGROUND OF THE DISCLOSURE a) Field of the Disclosure

This disclosure relates generally to sheet product dispensers and particularly to away-from-home type paper towel dispensers with an automatic advance assembly and an inter-operating manual advance assembly.

b) Background Art

Different types of single-use paper towel dispensers are available for the away-from-home market. For example, folded paper towel dispensers contain a stack of folded individual paper towel segments that are dispensed through a slot. Other dispensers dispense paper towel segments from a tightly wound paper roll. Such dispensers can dispense paper towel segments from perforated or continuous paper rolls. Perforated roll dispensers contain a continuous paper roll with longitudinally spaced, transversely extending perforations that define individual paper towel segments. In continuous roll dispensers, a continuous paper roll may be cut into individual segments by a cutting device located in the dispenser.

There are continuous roll dispensers which require a user to manually sever a paper segment from the continuous roll by pulling the paper against a serrated cutting blade. Such dispensers cannot control the length of the paper segment dispensed, and are thus susceptible to paper wastage. Another type of continuous roll dispenser is known as a portion control dispenser, which automatically cuts the paper roll into paper towel segments as the paper is being dispensed from the dispenser. In one type of portion control dispenser, the paper roll is rotatably mounted inside the dispenser and a leading edge of the paper is fed through a cutting roller and out of the dispenser through a slot. The paper is advanced manually by a user operating a paper advance mechanism or pulling on the leading edge of the paper roll. When the paper advances through the dispenser, the cutting roller rotates and a knife in the cutting roller extends radially outwards and punctures the paper, thereby severing a paper towel segment from the roll. The dispenser is designed to cut the paper into segments of defined length and only one at a time, thereby reducing paper wastage.

The continuous roll dispenser can be a "hands-free" (touchiess) type, i.e., designed to dispense paper towel segments without requiring the user to touch any part of the dispenser other than the leading edge of the paper roll. Such a design may be particularly desirable as the user is not exposed to germs or contaminants on other parts of the dispenser.

Motorized hands-free dispensers typically have a proximity or motion sensor within the body of the cabinet that detects a user's hand or hand movement. When the sensor detects a user, a motor inside the dispenser is activated. The motor is coupled to the paper roll and advances a paper segment out of the dispenser. Examples of such motorized hands-free dispensers are disclosed in U.S. Pat. Nos. 5,772,291, 6,412,679, 6,695,246, 6,892,620, and 6,903,654.

All of the dispensers disclosed in these patents require the user to wave an object or a portion of their body proximal to the sensor which is disposed within the upper cabinet. This may be counter-intuitive and may cause dysfunction if the user is not aware of the location of the sensor and rather pulls on the loose end of the paper towel or leading edge which is distended from the body of the dispenser.

SUMMARY OF THE DISCLOSURE

It is a general objective of the disclosure to provide an automated hands-free towel dispenser that solves at least some of the problems found in present towel dispensers. The disclosed paper product dispenser provides an improved hands-free towel dispenser with the sensor positioned in a very intuitive location on the dispenser. A further objective of the disclosure is to provide a paper towel dispenser that can operate in both an automated dispensing mode and in a manual dispensing mode.

According to one embodiment, there is disclosed a towel dispenser comprising a drive roller, a motor coupled to the drum and operable to rotate the drum, and a paper guide that guides a towel sheet onto the drum such that rotation of the drum past the selected position advances a portion of the towel sheet out of the dispenser. This dispenser is thus particularly useful for automatically dispensing a towel sheet portion to the user. The towel dispenser can further comprise a sensor positioned behind the engagement surface of a manual advance assembly for detecting a user, a controller communicative with the sensor and motor and programmed to activate the motor when the sensor detects a user and automatically dispense the towel sheet portion.

The dispenser can further comprise a one-way coupling which couples the motor to the drum in a first direction (drive direction) and decouples the motor in an opposite second direction, thereby enabling the motor to rotate the drum in an automatic dispensing mode and a user to rotate the drum in a manual dispensing mode. Examples of such couplings include one-way bearings, one-way clutches, and floating ratchets. Such a hybrid dispenser is particularly useful when power is unavailable to the motor, as the user can still operate the dispenser in the manual dispensing mode. The user can rotate the drum in a hands-on manual dispensing mode by engaging a manual advance assembly that is rotationally coupled to the cutting drive roller. The manual advance assembly can further comprise a push bar or other mechanism coupled to the drive roller; the user engages the manual advance assembly to manually rotate the cutting drum and dispense a portion of product. Therefore, in one form, if the manual advance assembly is used (push bar or other) or the user manually pulls the sheet from the dispenser, the cutting drum will rotate and the knife will extend to produce a cut sheet portion.

In one form, a DC power supply can be provided, electrically coupled to the motor and control systems. This power supply can include at least one battery, held by a standard battery tray for convenience. The power supply can also comprise an AC connector for connecting to an external AC power outlet, and an inverter or equivalent device, electrically coupled to the AC connector and to the motor. These two systems, the DC supply or the AC supply can be used in conjunction or independently. It may be desired when they are both utilized to have the AC supply connected in such a way to disconnect the DC power supply. This is used to reduce strain on the batteries and to reduce the electronics necessary to isolate each power system. These sorts of systems are well known in the art and often comprise a mechanical disconnect as a part of the plug between the AC inlet and the AC power cord. This mechanical disconnect is operatively configured to disconnect the electric connection between the battery tray and the motor and sensor when the AC power connection is utilized.

According to another aspect of the disclosure, there is provided a sheet product dispenser comprising a rotatable roller drum, a motor coupled to the roller drum and operable to rotate the drum, a paper guide that guides a towel sheet onto the roller drum such that rotation of the roller drum advances a portion of the towel sheet out of the dispenser, and a one-way rotational coupling which couples the motor to the drum in a first direction and decouples the motor from the drum in an opposite second direction, thereby enabling the motor to rotate the drum in an automatic dispensing mode and a user to rotate the drum in a manual dispensing mode.

The product dispenser may consist of a single drive roller, or alternately may comprise two or more drive rollers wherein one drive roller is coupled to the automatic advance assembly, and the second drive roller is coupled to the manual advance assembly.

DESCRIPTION OF THE PREFERRED EMBODIMENTS

This application incorporates by reference U.S. application Ser. No. 11/245,585 filed on Oct. 7, 2005, application Ser. No. 11/423,100 filed on Jun. 8, 2006, and Canadian application 2,541,645 entitled "Hybrid Towel Dispenser" and filed on Apr. 3, 2006 for all teachings, disclosures and purposes.

Figure 1:
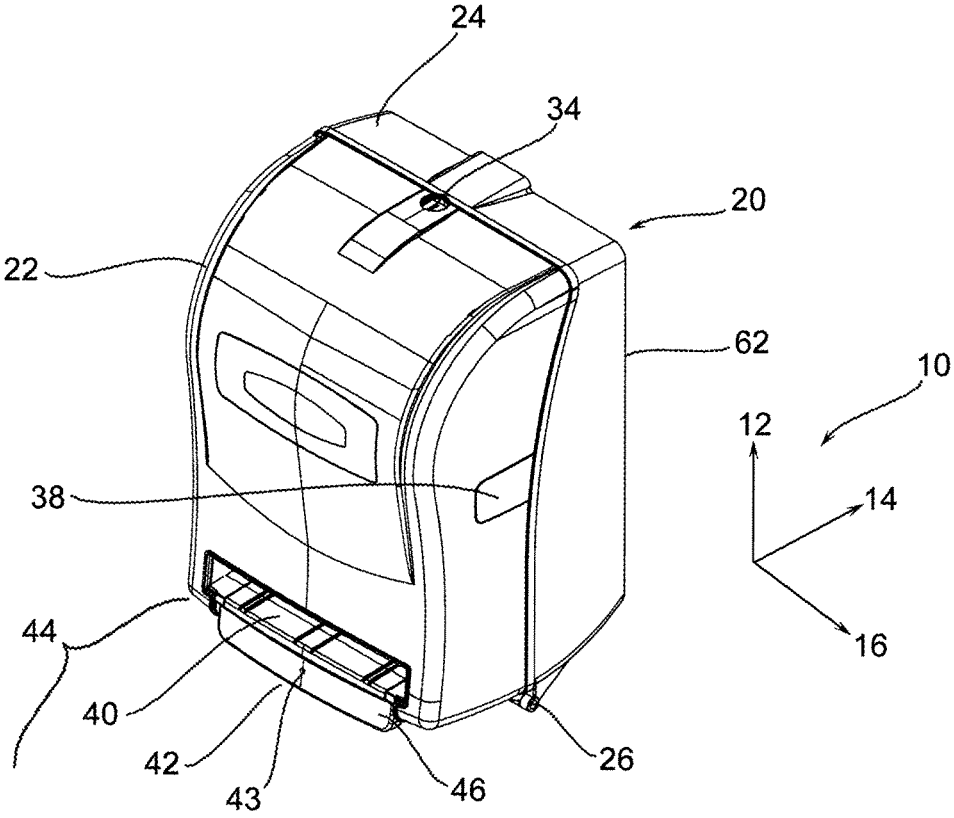
FIG. 1 is an isometric view of one embodiment of the disclosure generally from the top left portion.

Before beginning, to aid in understanding, an axis system 10 is shown in FIG. 1 comprising a vertical axis 12, a transverse axis 14, and a lateral axis 16. These directional terms as used in this description may aid in describing the embodiments of the disclosure and are not to be construed as limiting the embodiments to any particular orientation during operation, or in connection to another apparatus.

Figure 6:
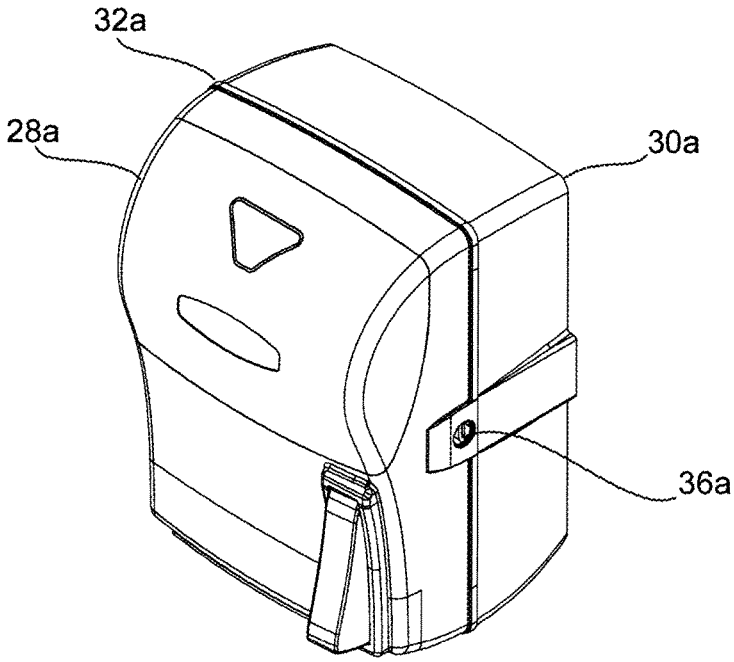
FIG. 6 is an isometric view of another embodiment of the disclosure generally from the top left side.
Figure 7:
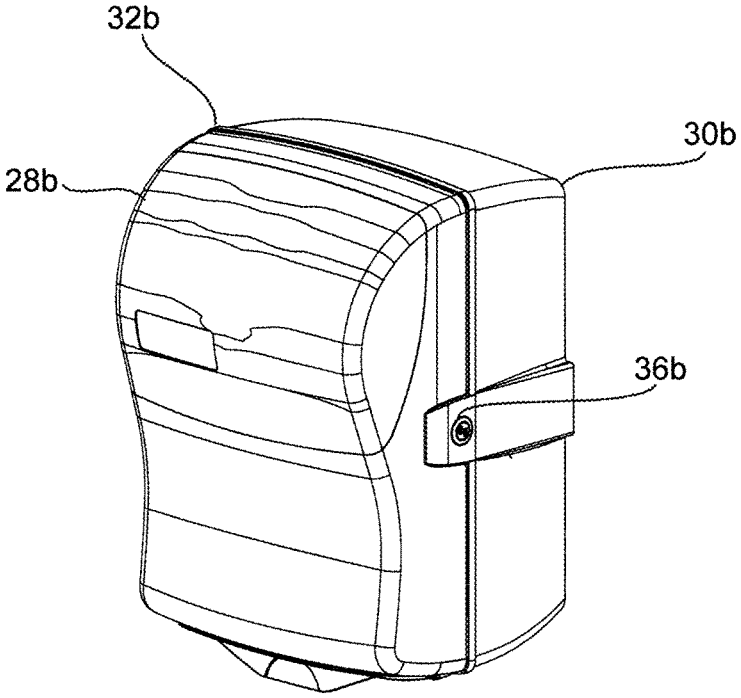
FIG. 7 is an isometric view of yet another embodiment of the disclosure from the front left side.
Figure 8:
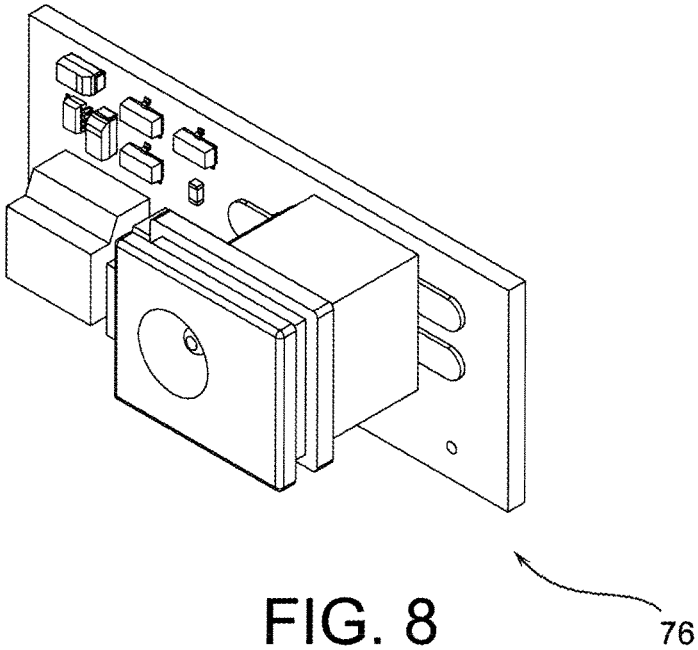
FIG. 8 is an isometric view of a power board in one form.

According to one embodiment of the disclosure, as shown in FIG. 1, a hands-free/manual hybrid dispenser 20 is disclosed comprising a front cover 22 and a back cover 24. The front cover 22 in one embodiment is coupled to the back cover 24 at a lower vertical position by way of a hinge 26. In the embodiments shown in FIGS. 6 and 7, a front cover 28 and a backside 30 are coupled by way of a hinge 32 along one lateral side. Referring back to FIG. 1, the upper vertical portion of the front cover 22 is secured to the back cover 24 by way of a latch 34. Similarly, the embodiment shown in FIG. 7 is coupled by way of a latch 36 on one lateral side.

In one embodiment, to allow visual observation of the condition of the roll of product within the casing, a view window 38 may be provided in one lateral side. Also, a product outlet 40 is shown in the lowermost portion adjacent a manual actuator 42. When one of the dispensing systems disclosed herein is activated, a portion of the sheet product will exit through this product outlet 40 such that a user can grasp it and remove it.

While similar towel dispensers are well known in the art having a front cover, a back cover, and a product outlet, the novel feature of this design is the hybrid actuating mechanism comprising both an automatic dispensing system and a manual dispensing system. The dispenser is configured such that a user reaching toward the manual actuator 42 will activate an object sensor 43 having a field of view 44 projecting through the user engagement surface 46 of the manual actuator 42. In this way, before the user contacts the user engagement surface 46, the sensor should detect the proximity of the user and automatically dispense a portion of product, given that the automatic dispensing system is functioning properly. If the automatic dispensing system is not actuating properly, the user will continue to reach toward the manual actuator 42, contacting the user engagement surface 46 and thus putting pressure upon the manual actuator 40 to manually dispense a portion of product.

Figure 2:
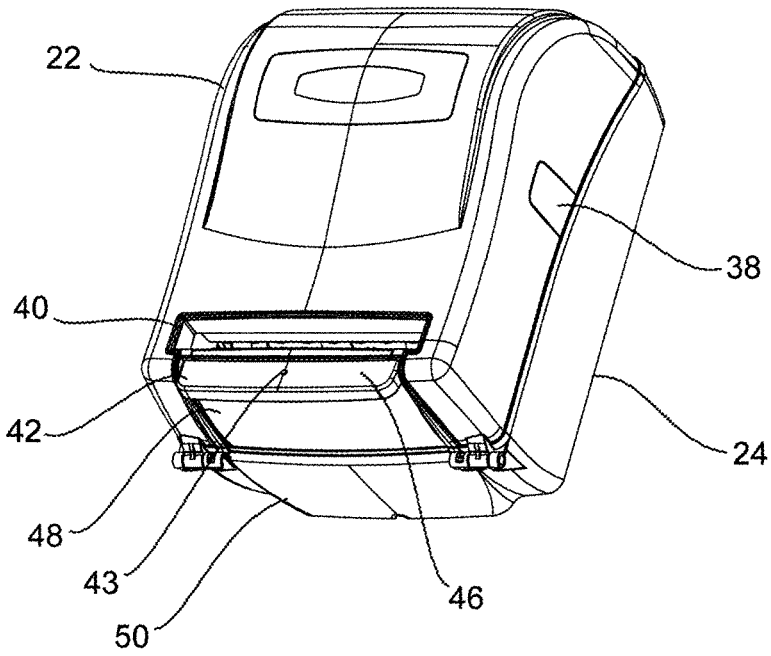
FIG. 2 is an isometric view of one embodiment of the disclosure generally from the bottom left side.

In the embodiment shown in FIG. 2, the manual actuator 42 comprises a cover plate 48 which is attached to the user engagement surface 46, such that when the manual actuator 42 is engaged and pressed toward the back cover 24, the cover plate 48 repositions to an interior portion of the cabinet. The cover plate 48 repositions above a bottom plate 50 which is rigidly affixed, to or formed as a unitary structure with, the back cover 24. In one embodiment, the object sensor 43 is disposed transversely behind the user engagement surface 46 such that the field of view 44 of the object sensor 43 projects through the user engagement surface 46. In one form, an indicator light 134 positioned behind the orifice 52 illuminates when the sensor 43 detects a user. For example, the indicator light may comprise a colored light, for example green, which will blink when a user is detected. The indicator light may be used to indicate other conditions, such as a steady green light when the dispenser is ready to dispense more product or a red light which may blink to indicate a low battery condition. The object sensor 43 will tend to reposition relative to the casing along with the manual actuator 42 when the manual actuator 42 is engaged. As the sensor 43 will be in communication with an automatic drive mechanism, a plurality of wires may be disposed vertically above the cover plate 48 within the dispenser 20 to protect them from wear and tear, and also to protect them from a negligent user.

Figure 3:
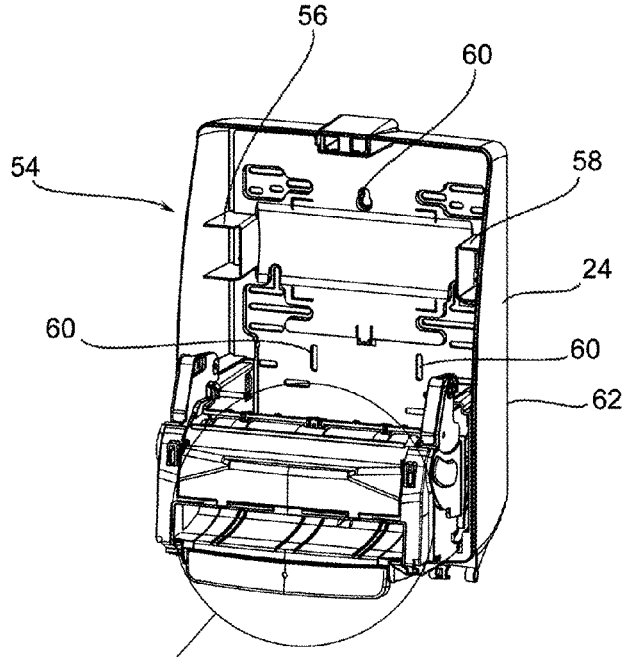
FIG. 3 is an isometric view of one embodiment of the disclosure with the front cover removed.
Figure 4:
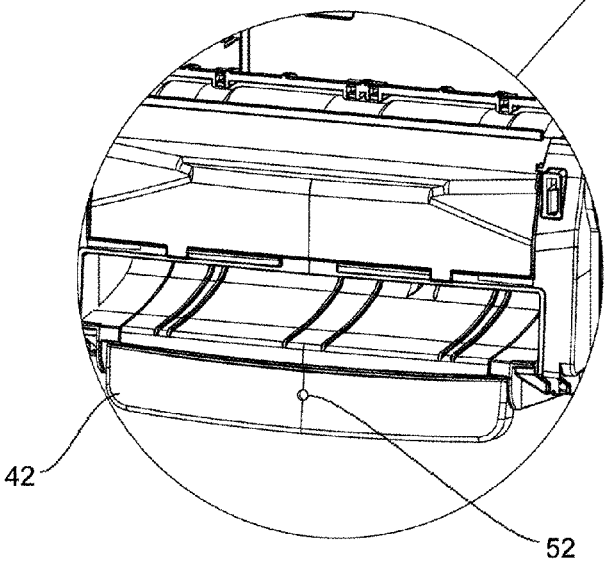
FIG. 4 is a detailed view of a portion of the embodiment shown in FIG. 3.

The embodiment shown in FIGS. 1 and 2 is also shown in FIG. 3 with the front cover 22 removed to more clearly show the internal workings thereof. Additionally, a sheet product holder, commonly known in the art, will be disposed in the upper portion 54 of the back cover 24. This sheet product holder is not shown to allow an easier understanding of the other workings of this dispenser. In one form, the sheet product holder is coupled via a plurality of extrusions 56 and 58 within the back cover 24. Also shown is a plurality of attachment openings 60 provided in the backside 62 of back cover 24, such that the towel dispenser 20 can be attached to a wall, door, or other surface.

Figure 5:
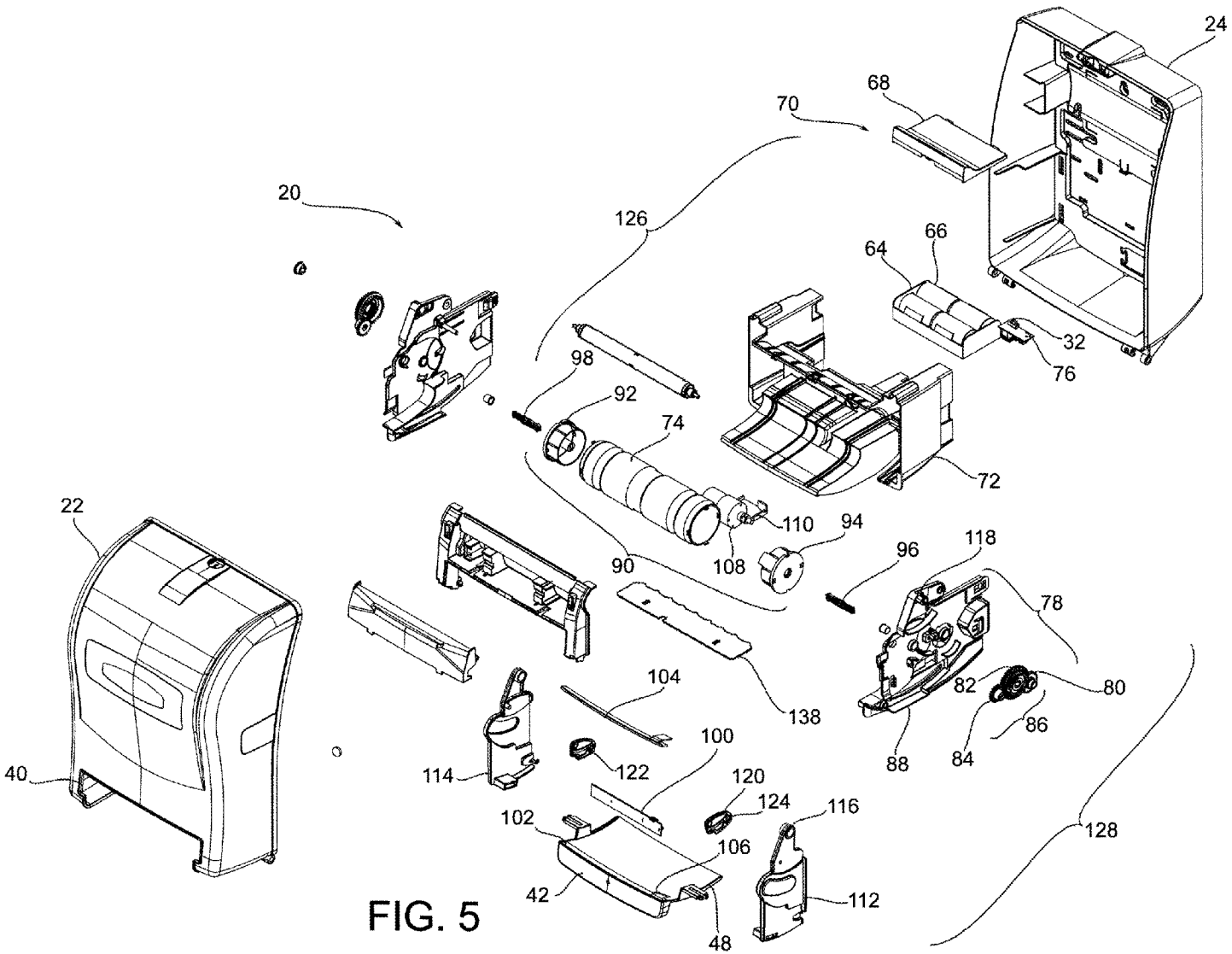
FIG. 5 is an isometric view of one embodiment of the disclosure with the parts exploded.

Moving now to FIG. 5, an exploded view of the integral parts of one embodiment is shown. Beginning with the front cover 22 and ending with the back cover 24, several of the parts will be explained and discussed. To operate in an automatic dispensing mode, a power supply is utilized to provide power to the sensor 43, the motor 108, and any control or indicator circuitry. Where it is desired that the towel dispenser 20 be self-contained, a battery tray 64 containing a plurality of batteries 66 may be included. To protect these batteries 66, a battery tray cover 68 is configured to be positioned adjacent the batteries 66 to complete the enclosure formed by the battery tray 64. The battery tray 64, batteries 66, and battery tray cover 68 interoperate as a DC power supply 70. This DC power supply 70 in one form is physically coupled to the product guide assembly 72. The product guide assembly 72 substantially functions to direct the product from the product roll, past a drive roller 74 and to exit through the product outlet 40, where it can be utilized.

The product guide assembly 72 in one form removably couples to the back cover 24 and also serves as a mounting location for a power board 76. This power board 76 is shown in more detail in FIG. 9 and will be discussed in more detail herein. On one or both sides of the product guide assembly 72 is a drive mechanism 78. The drive mechanism 78 substantially comprises a plurality of gears, including a driver gear 80, an idler gear 82, and a driven gear 84. These gears 80, 82 and 84 generally comprise a gear assembly 86 which is mounted to a drive mechanism plate 88. In one form, the driver gear 80 further comprises a one-way bearing, such that manual activation of the dispenser will not harm the motor and associated mechanism and/or automatic activation will not engage the manual assembly. The drive mechanism plate 88 couples to the product guide assembly 72 and also forms an attachment for a roller assembly 90, including a pinch roller 136.

In one form, the roller assembly 90 comprises a drive roller 74 having a right drive roller cap 92 and a left drive roller cap 94 removably affixed to either lateral end of the drive roller 74. The drive roller 74 is coupled to the drive mechanism 78 through a plurality of drive axles 96 and 98. These drive axles 96 and 98 are coupled to the driven gear 84 such that when the driven gear 84 rotates, force is translated to the drive roller 74 which is in frictional engagement with a portion of the sheet product, and as the drive roller 74 rotates in a given direction, a portion of the sheet product is dispensed through the product outlet 40.

In one form, a sensor plate 100 fits within a recess 102 within a front portion of the manual actuator 42. This sensor plate in 100 comprises the sensor 43 previously discussed. To further protect the sensor board 100, a sensor cover 104 is disposed upon the upper surface 106 of the manual actuator 42 encloses the recess 102. While the sensor board 100 may be in communication with the power board 76 through several different methods, a plurality of wires, which are not shown, will route power to the sensor board 100 and will also function to provide a signal by which the motor 108 is engaged. When the motor 108 is engaged and operational, the shaft 110 drives the driven gear 84 to rotate the gear assembly 86 to rotate the drive roller 74 and thus dispense a portion of product. In one form, the manual actuator 42 is coupled to a left side plate 112 and a right side plate 114. Each of these side plates includes a pivot 116 configured to interoperate with a pivot pin 118 coupled to the drive mechanism plate 88. A left ratchet 120 and right ratchet 122 are also fitted and coupled to the left side plate 112 and right side plate 114 respectively. These ratchets have a plurality of teeth 124 which are configured to interoperate with the gear assembly 86 only when the manual actuator 42 is utilized to dispense a portion of product. When the manual actuator 42 is not utilized, a spring or other member will position it and the attached ratchets 120 and 122 such that the teeth of the ratchet(s) do not engage the teeth of the gear assembly 86. Thus the automatic dispensing assembly will be allowed to function unhindered by the manual advance assembly. When the manual actuator 42 is manually engaged, the ratchet(s) and associated teeth will engage the teeth of the gear assembly 86, manually advancing a portion of product.

Figure 11:
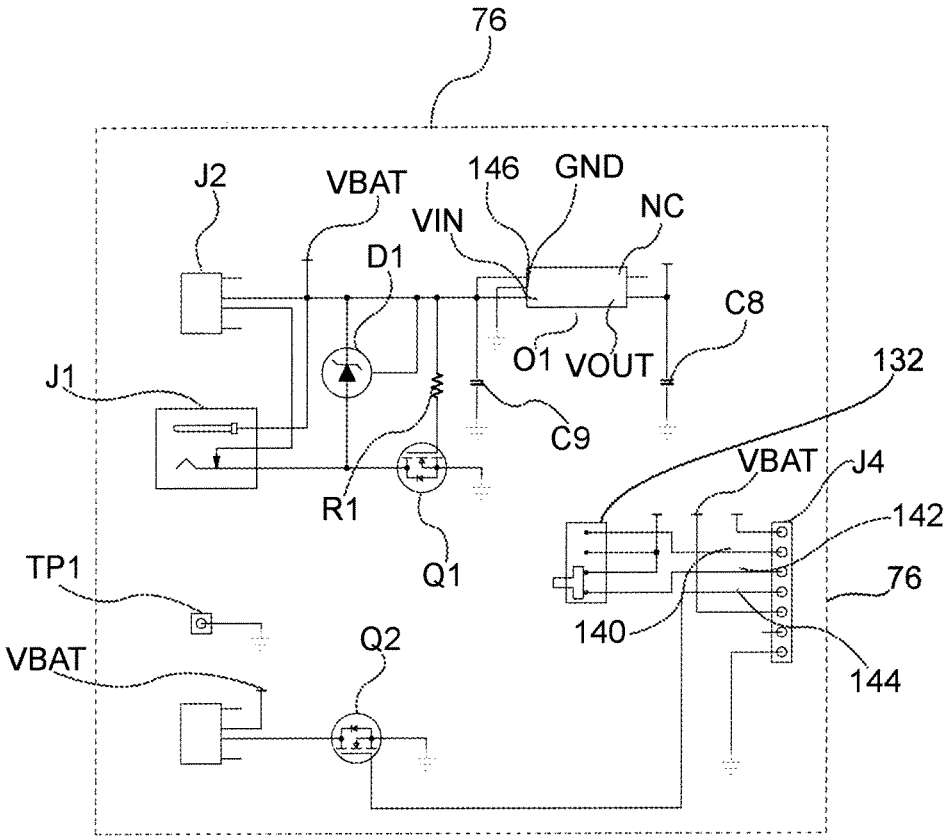
FIG. 11 is a schematic view of one embodiment of a power supply control circuit.
Figure 12:
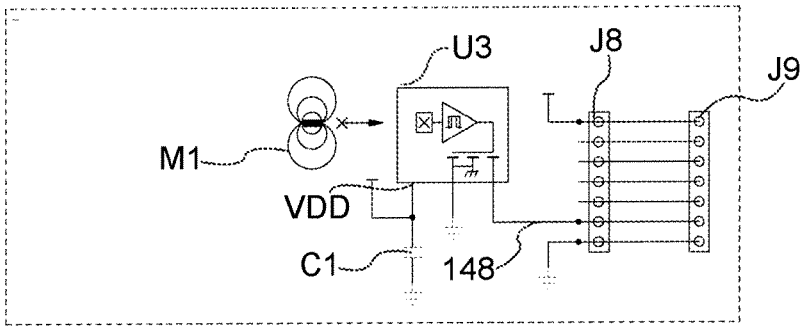
FIG. 12 is a schematic view of one embodiment of a drum sensor circuit.
Figure 13:
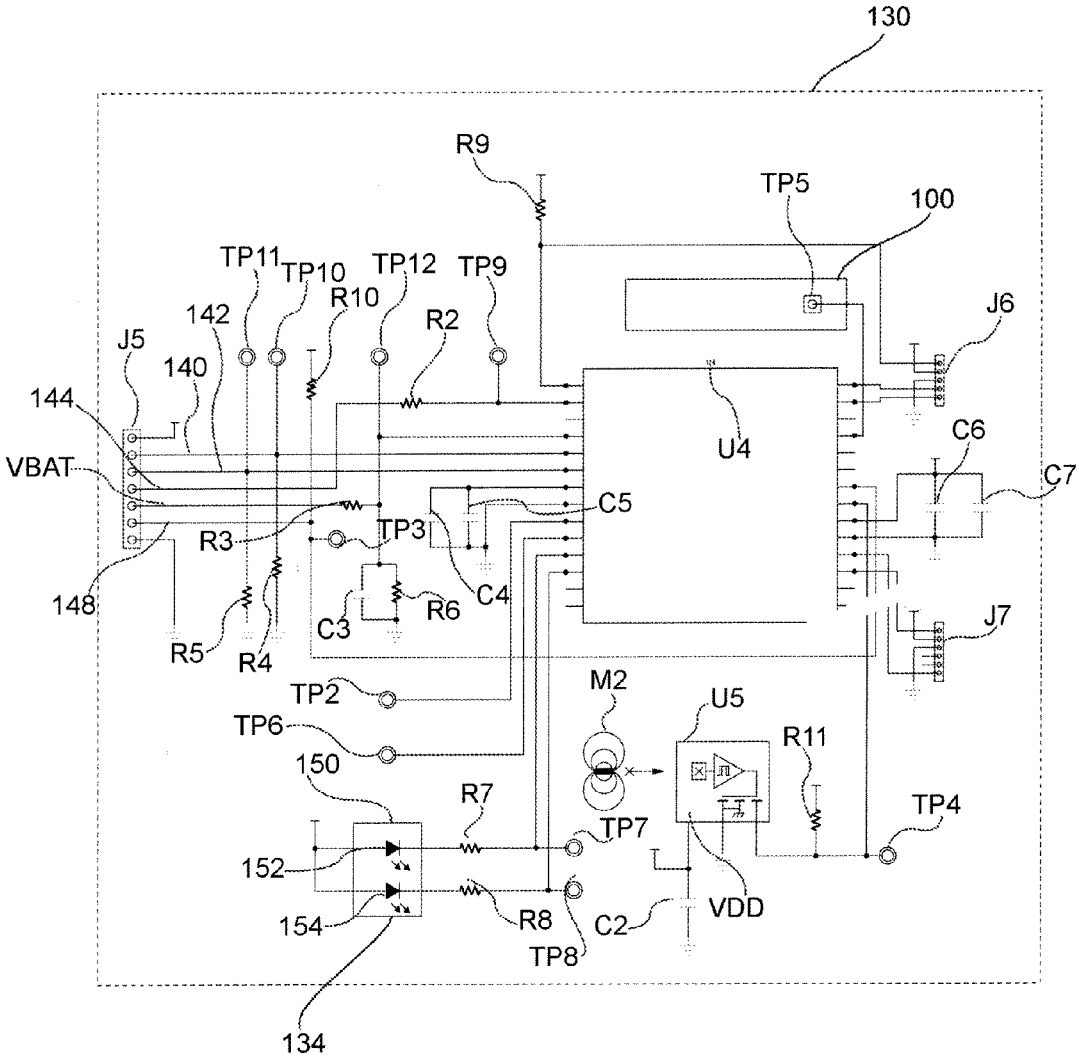
FIG. 13 is a schematic view of one embodiment of a sensor control circuit.

One form of the values of the components shown in the embodiment of circuit diagrams of FIGS. 11-13 is listed below. Other embodiments may also be utilized, without departing from the scope of the disclosure.

Capacitors
C1—0.1 uF
C2—0.1 uF
C3—0.1 uF
C4—1.0 uF 10%
C5—0.1 uF
C6—0.01 uF
C7—0.1 uF
C8—2u2F 1206 20% 10V
C9—2u2F 1206 20% 10V
Diodes
D1—GS0T15-GS08
Transistors
Q1—NTR4503N (for reverse battery protection)
Q2—NTR4503N
Resistors
R1—
R2—10k
R3—11K3 1%
R4—10K
R5—10K
R6—10K 1%
R7—100R
R8—100R
R9—10K
R10—
R11—10K
Other
J1—CUI POWER JACK PJ 015A (Plugging in the adapter will open connection from negative battery terminal to ground)
J2—JSTHDR S2B PH SM4 (Battery tray)
J3—JST HDR S2B PH SM4 (2-wire motor connector)
J4—SM SIP 7×1.00MM (Board to board cable harness)
J5—SM SIP 7×1.OOMM (Board to board cable harness)
J6—5PIN SIP 050MIL Programming & Development Header
J7—6PIN SIP 100MIL UART Debug Connector
J8—SM SIP 7×1.00MM J9—SM SIP 7×1.00MM
M1—Drum Magnet
M2—Door magnet
TP1—TP PTH 035MIL (Blade static strap grounding point)
TP5—TP PTH 030 MIL
S1—TYCO SP3T STS131PC04 (Paper length selector)

| Slider (S1) Position | Short Sense | Long Sense | Paper Length |
|---|---|---|---|
| 1-2 | high | low | Short |
| 2-3 | low | low | Medium |
| 3-4 | low | high | Long |

U1—SOT-23-5 LP2980IM5-3.3
U3—ALLEGRO A3211 SOT-23W (Drum Rotation Sensor)
U4—PIC16F726 SOIC-28, SSOP-28
U5—ALLEGRO A3211 (Chassis open/paddle activation sensor)

Notes

1. All resistors are thick film, 0603, 1/10W, 5% tolerance unless specified.
2. All capacitors are X7R, 0603, 50V, 20% tolerance unless specified.
3. All test points (TPnn) are 40 mil diameter pads (no drill hole) unless otherwise specified.
4. D1.2 (NC) is connected to VBAT for ease/convenience of routing VBAT on PCB When the automatic advance assembly 126 is operating, a user will reach toward the user engagement surface 46 of the manual actuator 42, entering the field of view 44 of the sensor 43, which thus sends a signal to the motor 108 which will function to automatically dispense a portion of product. When the automatic advance assembly is not operational, such as when no power supply is available, the manual advance assembly 128 will be utilized as previously discussed. Once a portion of product is dispensed, the cutter 138 is utilized to separate the dispensed portion from the remaining portion of product.

Figure 9:
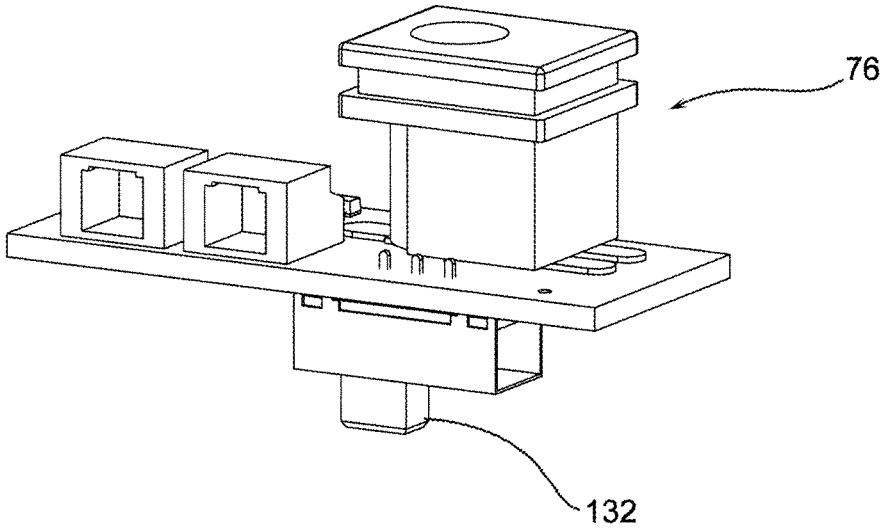
FIG. 9 is an isometric view of the power board of one embodiment of the disclosure inverted from the arrangement shown in FIG. 8.
Figure 10:
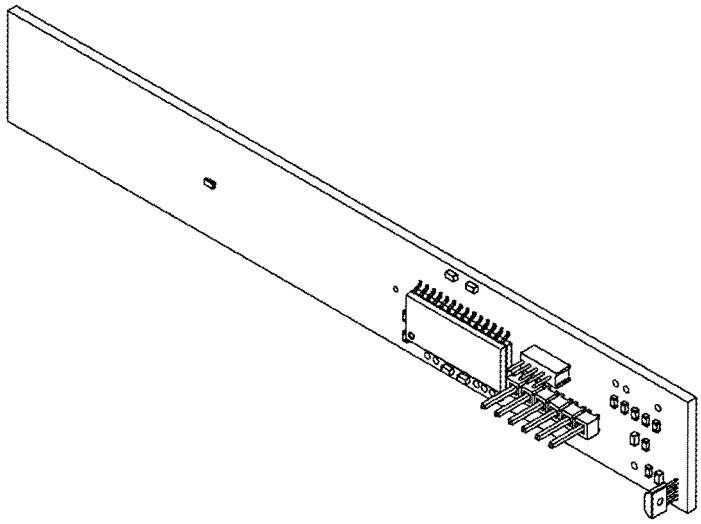
FIG. 10 is one embodiment of the sensor board, as shown in FIG. 5.

While the term "field of view" is used in this description of the embodiments, this should not be understood to be limited to a visual sensor. In one embodiment, the sensor plate 100 is formed as a capacitive sensor which can detect objects within a limited range. Even though there is no visual aspect to these sensors, the term "field of view" is still often used to determine the area in which an object can be sensed. Such capacitive sensors are a relatively recent innovation, and are often found in personal computer touch pads and portable media players including mobile phones. An article in *Electronic Product Design* (*EPD*) *Magazine* of Dec. 1, 2006 does a relatively good job of explaining the operation of the users. This article is incorporated herein by reference. A capacitive sensor in one form is a copper sensor plate 100 connected to a controller circuit 130 as shown in FIG. 13. This sensor plate 100 may be formed on the same substrate as the controller circuit 130. This controller circuit 130 detects input as a change in capacitance of the sensor 100. In one form, the controller circuit 130 simultaneously may sense an open casing door by way of a sensor sensing the magnetic flux field from a door magnet M2 of FIG. 13 or equivalent sensor. The controller circuit 130 may also include a drum rotation sensor sensing the magnetic flux field from a drum magnet M1. In some experimental dispensers, rotation of the drive roller 74 was mistaken as a user in proximity to the sensor plate 100. This faulty sensing is a problem in that the apparatus may continue to dispense product continuously. Thus it will be desired to dispense a portion of product and discontinue sensing while the motor 108 and/or drive roller 74 are in operation. Additionally, a maintenance person checking on the status of the volume of product remaining in the dispenser 20 or replacing the same will tend to set off dispensing of the product. This is not desired when the front cover is opened, allowing access to the interior for replacing of the product, the replacing of the batteries, or other actions. Thus, when the door magnet M2 detects that the front cover 22 is in the open position, the controller circuit 130 will not allow dispensing of product. In one form, the indicator light 134 will indicate that the dispenser is not ready to dispense product, such as by a red blinking light Depending on many factors such as location, common use, clientele, financial concerns etc., it may be desired to control the amount of product dispensed in each cycle. Therefore, a paper length adjustment switch 132 may be provided as shown in FIGS. 9 and 11. One possible placement of the paper length adjustment switch 132 is upon the power board 76 as shown in FIG. 5. In one form, the paper length adjustment switch 132 comprises a single pull triple throw selector switch which will allow for short, medium, or long paper lengths being dispensed during each cycle. Obviously other selector switches could be utilized for a wide range of paper lengths.

Figure 14:
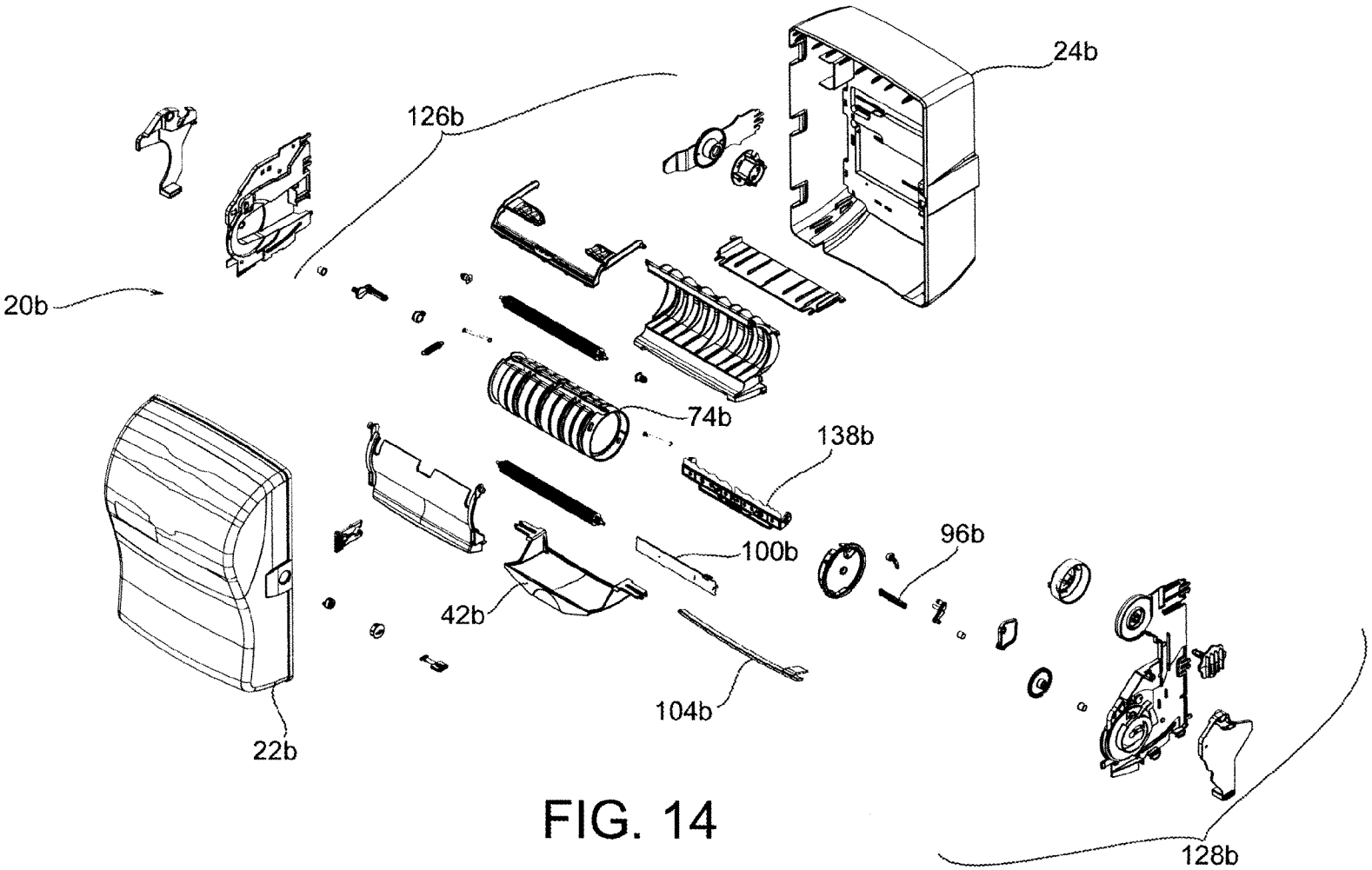
FIG. 14 is an isometric view of another embodiment of the disclosure with the parts exploded.

In the embodiment shown in FIG. 14, the dispensing and cutting apparatus, as disclosed in applicants' prior application U.S. Ser. No. 11/245,585, is combined with the sensor device located in the manual actuator shown above.

The connector J2 in one form may be a connection to an external power source or a battery supply. To protect against polarity problems in the event that a battery is placed in backwards, a reverse battery protector Q1 may be provided. A power supply portion S1 in one form provides a select switch which allows a user to select between short, medium and long paper lengths. The switch Q2 provides a switch for the motor to use a very low-cost switch for a hot lead. Connector J6 in one form is a program connector coupled to the microcontroller or main processor U4. This connector J6 is utilized as the product is assembled. There is a small portion of the power supply electrically isolated in one form, so it can be programmed without the product being taken apart. A cable connection may be utilized between J4 and J5 to electronically communicate between the two circuit boards shown in FIGS. 15 and 16. The circuit U4 is a main processor which in one form includes a capacitive flux sensor 100*b* which is a copper surface forming part of a capacitor. Forming the sensor as a printed circuit in combination with the main processor U4 provides an inexpensive, compact, and convenient sensor/ The entire microcontroller may be disposed within the push bar 42B of FIG. 14. Thus the microcontroller operates as a capacitor and comprises a large copper surface on the circuit board itself. Edge circuit boards are provided with copper where the construction allows for layers of copper to be placed on the board to create the capacitance pad.

Sensor U5 is a sensor which senses a magnetic flux field from a magnet M2 which in one form is positioned with the casing door 22B. The magnet effectively communicates when the casing door 22B is open and further when the casing door 22B is open, the ability of the dispenser to automatically provide product is disabled. Therefore the magnet switch U5 in one form doubles as a manual advance push bar sensor and a detector of when the chassis is open. When the manual advance push bar 42B is pushed, the automatic advance assembly 126B is disabled from providing product. Therefore, as shown in FIG. 16, the sensor U5 has two functions of detecting whether the chassis is open and further detect when the manual advance push bar 42B has been engaged, whereby any sort of activation from the copper pad proximity sensor 100B would be effectively temporarily disabled.

Figure 16:
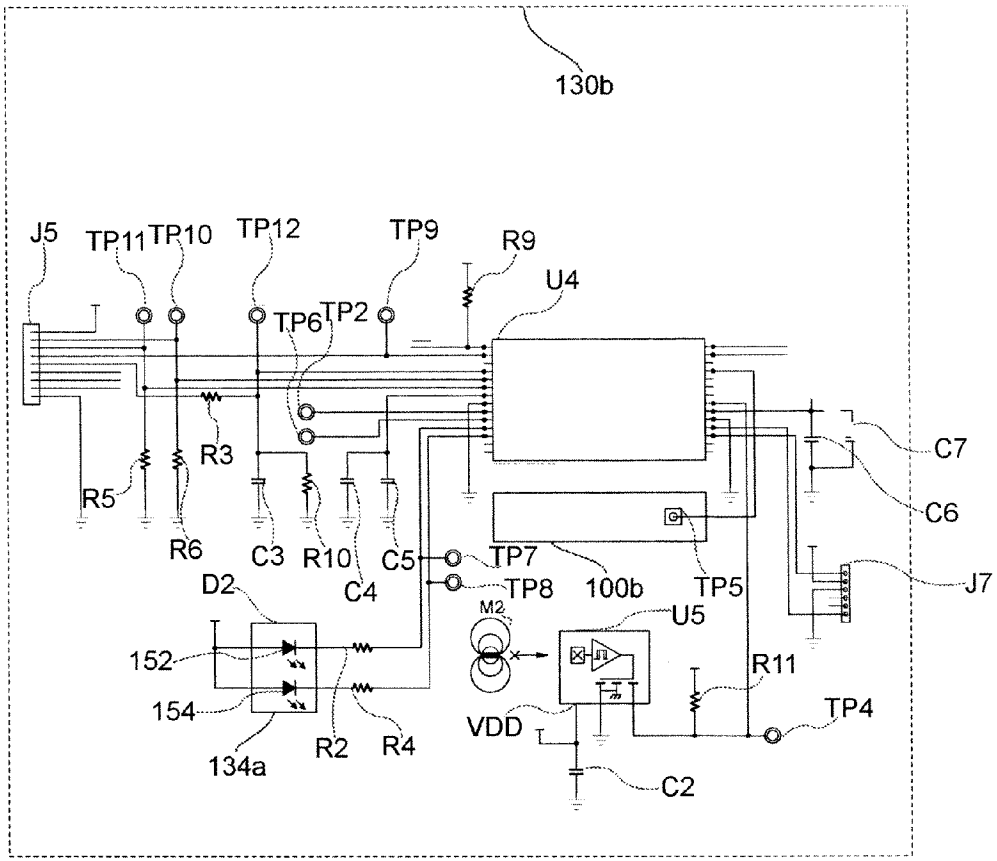
FIG. 16 is one embodiment of the sensor board as shown in FIG. 14.
Figure 15:
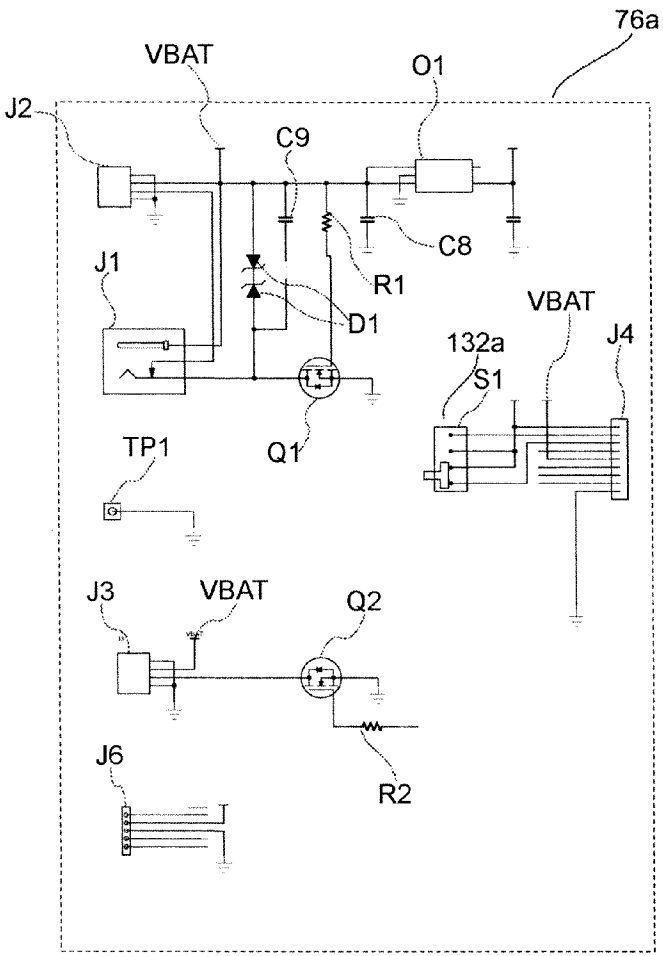
FIG. 15 is an exploded view of the power board of one embodiment of the disclosure.

One form of the values of the components shown in the embodiment of circuit diagrams of FIGS. 14-16 is listed below. Other embodiments may also be utilized, without departing from the scope of the disclosure.

Capacitors
C1—2u2 uF
C2—0.1 uF
C3—0.1 uF
C4—1.0 uF
C5—0.1 uF
C6—0.01 uF
C7—0.1 uF
C8—2u2F
C9—2u2F
Diodes
D1—15MA20CTAT3
Transistors
Q1—NTR4503N (for reverse battery protection)
Q2—NTR4503N
Resistors
R1—100R
R2—100R
R3—30K1
R4—10K
R5—10K
R6—10K
R7—100R
R9—10K
R10—10K
R11—10K
Other
140—Short Sense
142—Long Sense
144—Motor Fn
146—On/Off
148—Drum Sense
150—Dual LED
152—Red
154—Green
J1—CUI POWER JACK PJ 015A (Plugging in the adapter will open connection from negative battery terminal to ground)
J2—S2B PH SM4 (Battery tray)
J3—JST HDR S2B PH SM4-TB (2-wire motor connector)
J4—SM SIP 9×1.00MM (Board to board cable harness)
J5—SM SIP 9×1.OOMM (Board to board cable harness)
J6—5PIN SIP 050MIL Programming & Development Header
J7—6PIN SIP 100MIL UART Debug Connector
M1—Drum Magnet
M2—Door magnet
TP1—TP PTH 035MIL (Blade static strap grounding point)
TP5—TP PTH 030 MIL
S1—TYCO SP3T STS131PC04 (Paper length selector)

| Slider (S1) Position | Short Sense | Long Sense | Paper Length |
|---|---|---|---|
| 1-2 | high | low | Short |
| 2-3 | low | low | Medium |
| 3-4 | low | high | Long |

U1—SOT-23-5 LP2980IM5-3.3
U3—ALLEGRO A322EUA-T (Drum Rotation Sensor)
U4—PIC16F726 SOIC-28, SSOP-28
Notes
1. All resistors are thick film, 0603, 1/10W, 5% tolerance unless specified.
2. All capacitors are X7R, 0603, 50V, 20% tolerance unless specified.
3. All test points (TPnn) are 40 mil diameter pads (no drill hole) unless otherwise specified.
4. D1.2 (NC) is connected to VBAT for ease/convenience of routing VBAT on PCB In the embodiment shown in FIG. 14, the length of dispensed product is determined by time of operation of the motor. Therefore, the charge of the battery influences the length of the motor operation, and thus the length of the dispensed product. In the version shown in FIG. 14, which relates to a drum cutting embodiment, the rotational sensor U3 of FIG. 12 detects a certain rotation of the drum 74B and the over centered spring takes over, providing rotation thereof for a fixed increment amount of towel length based upon the diameter of the drum 74B. With the version shown in FIG. 5, which in one embodiment is a manual tear system, the circuitry allows for a general reading of the battery power which has an influence upon the velocity of the actuator motor advancing the product the proper distance so as to increment a prescribed amount of product per activation of the sensor. The available energy in a battery is related to its voltage. Therefore, in a battery, the terminal voltage drop is fairly linear over time; they typically have 1.5 volts brand-new and are "dead" when there is 0.85 volts of differential between the terminals. As the batteries are no longer functional at this point, the external power supply (if operational) or the manual advance assembly 128 can be used to dispense product.

While the present disclosure is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The disclosure in its broader aspects is therefore not limited to the specific details, representative apparatus and methods, and illustrative examples shown and described. Accordingly, departures may be made from such details without departing from the spirit or scope of applicants' general concept.

We claim:

1. A product dispenser configured to dispense a roll of sheet product comprising:

a. At least one drive roller operatively configured to frictionally engage a portion of the sheet product and expel the portion of sheet product when rotated;

b. an automatic advance assembly comprising a motor operatively coupled to the drive roller and operatively configured to rotate the drive roller when the motor is activated;

c. an object sensor in contact with the automatic advance assembly, the object sensor operatively configured to detect an object proximate to the sensor, before the object physically contacts the sensor;

d. a manual advance assembly coupled to the drive roller; the manual advance assembly comprising an engagement surface, the manual advance assembly manually operable by a user to rotate the drive roller;

e. a one-way coupling operatively configured to engage the motor to the roll of sheet product when the object sensor engages the automatic drive assembly, and disengage the motor from the roll of sheet product when the user pulls on the leading edge of the sheet product or otherwise engages the manual advance assembly such that the portion of the sheet product is dispensed; and f. wherein the sensor comprises a sensing path in front of the engagement surface of the manual advance assembly and wherein the object sensor is affixed/coupled to the manual advance assembly and electrically coupled to the motor such that the object sensor moves with the engagement surface of the manual advance assembly when the manual advance assembly is utilized.

2. The product dispenser as recited in claim 1 wherein the object sensor is formed as a portion of a printed circuit board in combination with a microprocessor circuit.

3. The product dispenser as recited in claim 1 wherein the object sensor comprises at least one of a motion sensor, infrared sensor, light sensor, laser sensor, or an acoustic sensor positioned upon the manual advance assembly.

4. The product dispenser as recited in claim 1 further comprising a one-way coupling operatively configured to couple the motor to the drive roller when rotated in a first direction and decouple the motor from the drive roller when rotated in an opposite second direction, thereby enabling the motor to rotate the drive roller in an automatic dispensing mode and the user to rotate the drive roller in a manual dispensing mode.

5. The product dispenser as recited in claim 4 wherein the coupling is a one-way bearing.

6. The product dispenser as recited in claim 1 consisting of a single drive roller.

7. The product dispenser as recited in claim 1 comprising at least two drive rollers wherein one drive roller is coupled to the automatic advance assembly, and the second drive roller is coupled to the manual advance assembly.

8. The product dispenser as recited in claim 1 further comprising a self-contained power supply.

9. The product dispenser as recited in claim 1 further comprising circuitry to influence the length of sheet product dispensed in an automatic mode based in part on the power remaining in the self-contained power supply.

10. The product dispenser as recited in claim 9 further comprising an AC power connection operatively configured to disconnect the electric connection between the battery tray and the motor and sensor when the AC power connection is utilized.

11. The product dispenser as recited in claim 1 wherein the manual advance assembly further comprises a push bar pivotally coupled to the drive roller, and the manual advance assembly is operatively configured such that the user exerts force upon the push bar to operate the manual advance assembly.

12. The product dispenser as recited in claim 1 further comprising a drive roller sensor and circuitry operatively configured to detect rotation of the drive roller and delay the dispensing of a second portion of product for an interval.

13. The product dispenser as recited in claim 1 further comprising a casing door open sensor operatively configured to detect when the casing door is open and delay the dispensing of a portion of product.

14. The product dispenser as recited in claim 13 further wherein the casing door open sensor is operatively configured to additionally detect when the manual advance assembly is utilized and delay the automatic dispensing of a portion of product.

15. The product dispenser as recited in claim 1 further comprising a paper length adjustment switch operatively configured to allow adjustability of the length of the dispensed portion of sheet product.

16. A sheet product dispenser comprising:

a. an advance system operatively configured to engage a portion of the sheet product and expel the portion of sheet product when engaged;

b. an automatic advance assembly comprising a motor coupled to the advance system and operable to rotate the advance system when the motor is activated;

c. an object sensor coupled to the automatic advance assembly operatively configured to sense an object proximate to the object sensor before the object physically contacts the object sensor and activate the motor and operate the advance system;

d. a manual advance assembly rotationally coupled to the advance system; the manual advance assembly comprising an engagement surface, the manual advance assembly manually operable by a user to engage the advance system when the automatic advance assembly fails to operate, said object sensor located on the manual advance assembly movable with the engagement surface when the engagement surface is manually engaged by a user and repositioned by the user to operate the manual advance assembly and rotate the advance system.

17. The product dispenser as recited in claim 16 wherein the manual advance assembly further comprises a push bar having said engagement surface and pivotally coupled to a dispenser casing, and wherein a user exerts force upon the push bar to engage the manual advance assembly, said object sensor located on the push bar.

18. The product dispenser as recited in claim 16 further comprising a self-contained power supply electrically coupled to the motor.

19. A sheet product dispenser comprising:

a. a rotatable driver roller;

b. a motor coupled to the drive roller and operable to rotate the driver roller;

c. a paper guide that guides a portion of the sheet product onto the driver roller such that rotation of the driver roller advances a portion of the sheet product out of the dispenser;

d. a one-way rotational coupling which couples the motor to the driver roller in a first direction and decouples the motor from the driver roller in an opposite second direction, thereby enabling the motor to rotate the driver roller in an automatic dispensing mode and alternatively a user to rotate the driver roller in a manual dispensing mode;

e. a manual advance assembly rotationally coupled to the driver roller and including a movable actuator structure engageable and operable by a user to rotate the driver roller in the manual dispensing mode;

f. an object sensor located on said movable actuator structure operatively connected to the motor and operatively configured to sense an object proximate to the object sensor, energize the motor and cause rotation of said driver roller to advance a portion of sheet product out of the dispenser before the object physically contacts the movable actuator structure to move the movable actuator structure and rotate the driver roller in manual dispensing mode.

20. The sheet product dispenser as recited in claim 19 wherein the movable actuator structure comprises a push bar rotationally coupled to the driver roller and operatively configured such that the user exerts force upon the push bar to operate the manual advance assembly.

21. A product dispenser configured to dispense a roll of sheet product comprising:

a. at least one drive roller operatively configured to frictionally engage a portion of the sheet product and expel the portion of sheet product when rotated;

b. an automatic advance assembly comprising a motor operatively coupled to the drive roller and operatively configured to rotate the drive roller when the motor is activated;

c. an object sensor in contact with the automatic advance assembly, the object sensor operatively configured to detect an object proximate to the sensor, before the object physically contacts the sensor;

d. a manual advance assembly coupled to the drive roller; the manual advance assembly comprising an engagement surface, the manual advance assembly manually operable by a user to rotate the drive roller;

e. a one-way coupling operatively configured to engage the motor to the roll of sheet product when the object sensor engages the automatic drive assembly, and disengage the motor from the roll of sheet product when the user pulls on the leading edge of the sheet product or otherwise engages the manual advance assembly such that the portion of the sheet product is dispensed; and f. wherein the sensor comprises a sensing path in front of engagement surface of the manual advance assembly and wherein the object sensor comprises a capacitance proximity sensor positioned within the manual advance assembly.

* * * * *